US006681953B2

(12) United States Patent
Au

(10) Patent No.: US 6,681,953 B2
(45) Date of Patent: Jan. 27, 2004

(54) RAIL-TRACK DISPLAY BOX

(75) Inventor: Kinsen Ka Fai Au, Tuen Mun (HK)

(73) Assignee: Nationalpak Limited, Tuen Mun (HK)

( * ) Notice: Subject to any disclaimer, the term of this patent is extended or adjusted under 35 U.S.C. 154(b) by 99 days.

(21) Appl. No.: 10/092,649

(22) Filed: Mar. 6, 2002

(65) Prior Publication Data

US 2003/0168378 A1 Sep. 11, 2003

(51) Int. Cl.[7] ..... B65D 43/14

(52) U.S. Cl. ..... 220/815; 206/6.1; 206/301; 220/345.4

(58) Field of Search ..... 206/6.1, 301, 566, 206/736, 740–745, 751–755, 758; 220/23.83, 23.86, 23.9, 297, 345.1–345.6, 348–351, 811–816

(56) References Cited

U.S. PATENT DOCUMENTS 4,216,858 A * 8/1980 Beauchamp ..... 206/759
4,496,050 A * 1/1985 Kirchner et al. ..... 206/753
4,717,020 A * 1/1988 Viira ..... 206/372
5,383,552 A * 1/1995 Dikowitz ..... 206/6.1
5,411,134 A * 5/1995 Temple et al. ..... 206/753
5,549,199 A * 8/1996 Lindsay ..... 206/308.1
6,478,160 B1 * 11/2002 Au et al. ..... 206/752

* cited by examiner

*Primary Examiner*—Jim Foster
(74) *Attorney, Agent, or Firm*—Raymond Y. Chan; David and Raymond Patent Group

(57) ABSTRACT

A rail-track display box includes an outer casing having a pair of elongated sliding tracks indented along two top edges of two parallel side walls of the outer casing respectively. An inner casing has a pair of guiding tracks indented on two outer surfaces of two side panels of the inner casing respectively. A cover has a pair of sliding pegs inwardly formed on two inner surfaces of two parallel side cover panels respectively and a pair of guiding pegs downwardly formed on two bottom edges of the side cover panels respectively. The cover is adapted to frontwardly slid to a display position that the sliding pegs are stopped at two front blocked ends of the sliding tracks respectively and the guiding pegs are stopped at two front stopped ends of the guiding tracks respectively, so as to open the rail-track display box for displaying the product.

20 Claims, 5 Drawing Sheets

RAIL-TRACK DISPLAY BOX

BACKGROUND OF THE PRESENT INVENTION

1. Field of Invention

The present invention relates to containers, and more particularly to a rail-track display box for package, storage, and display for gifts such as watches, jewelries, glasses, cosmetics, etc.

2. Description of Related Arts

The appearance of Jewelries and watches are critical for attaching customers' attention. As more and more designers provided variety of designs for customers to choose. Therefore, for each jewelry store, the amount for each design is limited. And the exact shape and size of each jewelry and watch is differently for each other. It is not economical to use different container for displaying, packaging, and storage. Not to mention it will spend store staff extra time for transfer the items for displaying container to package containers. It is desirable to use a container suitable for display and package. There are two types of conventional displayable jewelry box. In one type, the cover is hingely connected to the base, opening and closing the box will take extra effort and may be unsafe. In another type, the cover can be separated from the box. While the product is displayed, the cover is separated from its box. Since the cover is not connected to the box, it is easy to lose the cover.

The present invention has overcome the disadvantages of both types, the cover can be slid open with very little effort, and the cover can be linked with the base without the possibility of getting lost. Especially, for expensive jewelries or watches that need more protection and to be handled with care, the present invention will be very useful.

SUMMARY OF THE PRESENT INVENTION

A main object of the present invention is to provide a rail-track display box, wherein the cover is locked to both the outer casing and the inner casing in such a manner that the display item can be securely held in the inner casing so as to prevent the inner casing from being taken away accidentally.

Another object of the present invention is to provide a rail-track display box, which provides two rail-track arrangements to slidably engage the cover with the outer and inner casings, so as to enhance the securely sliding movement of the cover with respect to the outer casing.

Another object of the present invention is to provide a rail-track display box, wherein a display item is securely supported on the box in such a manner that when the cover is slidably flipped over from the casing, the display item can be placed horizontally or a certain angle so as to enhance the aesthetic appearance of the display item.

Another object of the present invention is to provide a rail-track display box, wherein the cover is adapted to slidably flip over to cover on top of the outer casing so as to protect the display item while storing or packaging, and prevent the display item from getting dusty.

Accordingly, in order to accomplish the above objects, the present invention provides a rail-track display box, which comprises an outer casing, an inner casing, and a cover.

The outer casing has a receiving chamber, a top opening communicating with the receiving chamber, and a pair of elongated sliding tracks indented along two top edges of two parallel side walls of the outer casing respectively, wherein each of the sliding tracks has a front blocked end and a rear blocked end.

The inner casing has a storage cavity for receiving a product therein and a lower portion disposed in the receiving chamber while an upper portion of the inner casing is exposed out of the receiving chamber. The inner casing further has a pair of guiding tracks indented on two outer surfaces of two side panels of the upper portion of the inner casing respectively, wherein each of the guiding tracks has a front stopped end and a rear stopped end.

The cover has a pair of sliding pegs inwardly and perpendicularly formed on two inner surfaces of two parallel side cover panels respectively and a pair of guiding pegs downwardly formed on two bottom edges of the side cover panels respectively, a distance of the two outer surfaces of the side panels of the inner casing being slightly smaller than a distance between the two inner surfaces of the two side cover panels of the cover, wherein the cover is placed on top of the outer casing while the two sliding pegs are slidably inserted into the two sliding tracks respectively and the two guiding pegs are slidably inserted into the two guiding tracks respectively.

The cover is adapted to slidably move between a display position and a storage position, wherein in the display position, the cover is slid frontwardly while the sliding pegs are stopped and positioned at the two front blocked ends of the sliding tracks respectively and the guiding pegs are stopped and positioned at the two front stopped ends of the guiding tracks respectively, so as to open the rail-track display box for displaying the product, and in the storage position, the cover is slid rearwardly while the sliding pegs are stopped and positioned at the two rear blocked ends of the sliding tracks respectively and the guiding pegs are stopped and positioned at the two rear stopped ends of the guiding tracks respectively, so that the cover is supported on the outer casing to enclose the storage cavity.

DETAILED DESCRIPTION OF THE PREFERRED EMBODIMENT

Figure 1:
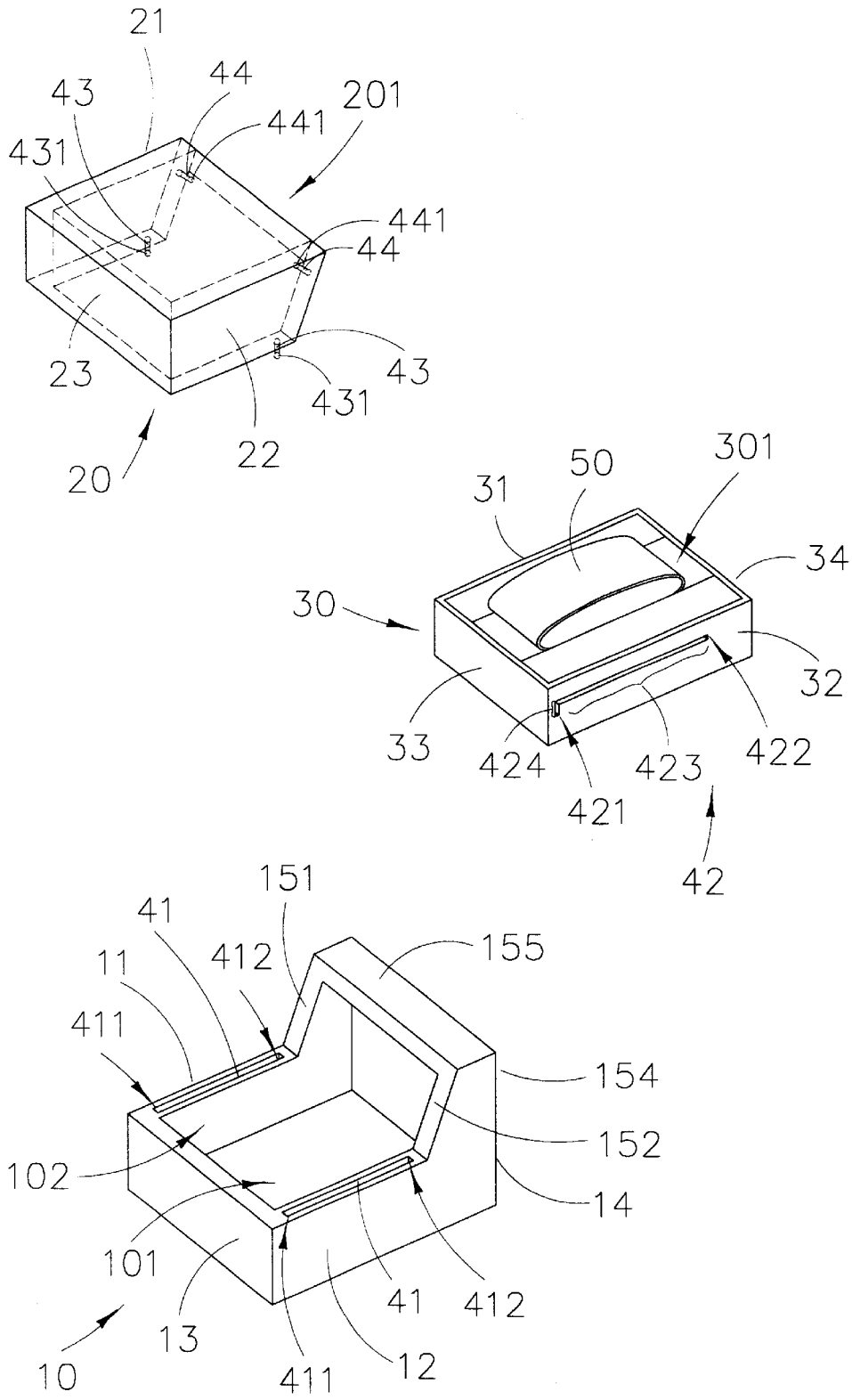
FIG. 1 is an exploded perspective view of a rail-track display box according to a first preferred embodiment of the present invention.

Referring to FIG. 1 of the drawings, a rail-track display box according to a first preferred embodiment of the present invention is illustrated, wherein the rail-track display box comprises an outer casing 10, an inner casing 30 received in the outer casing 10, and a cover 20 supported on the outer casing 10 to enclose the inner casing 30 within the outer casing 10 and the cover 20.

The outer casing 10 has a receiving chamber 101, a top opening 102 communicating with the receiving chamber 101, and a pair of elongated sliding tracks 41 indented along two top edges of two parallel side walls 11, 12 of the outer casing 10 respectively, wherein each of the sliding tracks 41 has a front blocked end 411 and a rear blocked end 412.

The inner casing 30 has a storage cavity 301 for receiving a product therein wherein a lower portion of the inner casing 30 is disposed in the receiving chamber 101 while an upper portion of the inner casing 30 is exposed out of the receiving chamber 101. The inner casing 30 further has a pair of guiding tracks 42 indented on two outer surfaces of two side panels 31, 32 of the upper portion of the inner casing 30 respectively, wherein each of the guiding tracks has a front stopped end 421 and a rear stopped end 422.

The cover 20 has a pair of sliding pegs 43 inwardly and perpendicularly formed on two inner surfaces of two parallel side cover panels 21, 22 respectively and a pair of guiding pegs 44 downwardly formed on two bottom edges of the side cover panels 21, 22 respectively. A distance of the two outer surfaces of the side panels 31, 32 of the inner casing 30 is slightly smaller than a distance between the two inner surfaces of the two side cover panels 21, 22 of the cover 20, wherein the cover 20 is placed on top of the outer casing 10 while the two sliding pegs 43 are slidably inserted into the two sliding tracks 41 respectively and the two guiding pegs 44 are slidably inserted into the two guiding tracks 42 respectively.

Figure 3:
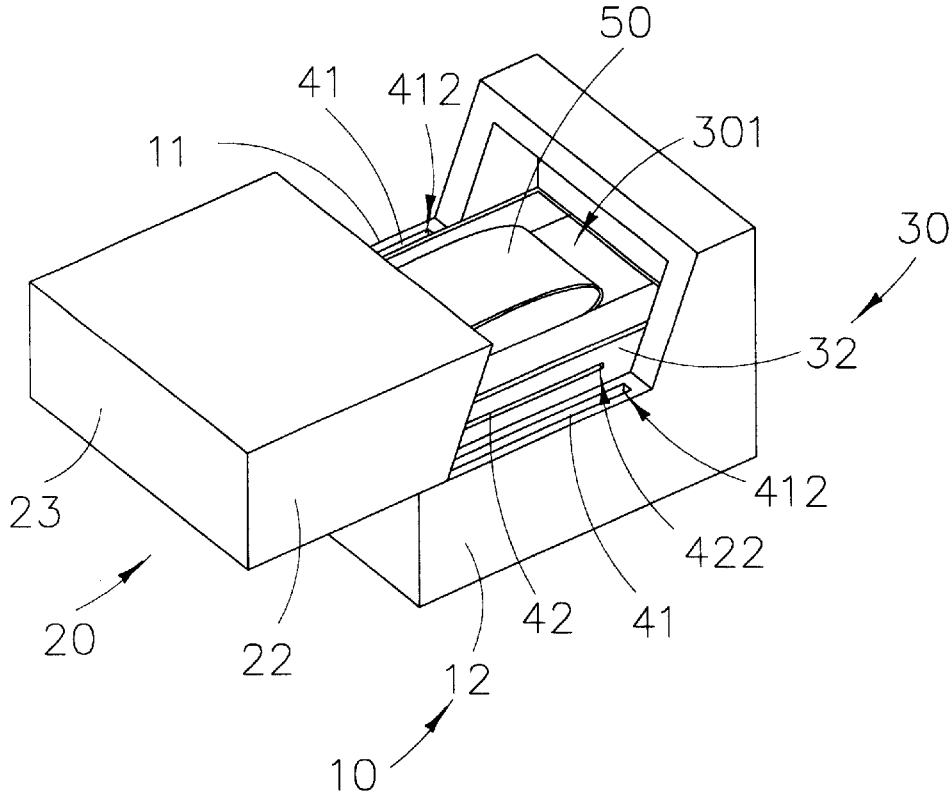
FIG. 3 is a perspective view of the rail-track display box in a display position according to the above first preferred embodiment of the present invention.

The cover 20 is adapted to slidably move between a display storage position, and a storage position, wherein in the display position as shown in FIG. 3, the cover 20 is slid frontwardly while the sliding pegs 43 are stopped and positioned at the two front blocked ends 411 of the sliding tracks 41 respectively and the guiding pegs 44 are stopped and positioned at the two front stopped ends 421 of the guiding tracks 42 respectively, so as to open the rail-track display box for displaying the product, and in the storage position, the cover 20 is slid rearwardly while the sliding pegs 43 are stopped and positioned at the two rear blocked ends 412 of the sliding tracks 41 respectively and the guiding pegs 44 are stopped and positioned at the two rear stopped ends 422 of the guiding tracks 42 respectively, so that the cover 20 is supported on the outer casing 10 to enclose the storage cavity 301 of the inner casing 30.

According to the preferred embodiment, the rail-track display box is preferably made of stiffness material such as cardboard or plastic because of the ease and the low cost of construction. Thus, the product can be well protected in the rail-track display box while package or storage.

The outer casing 10 further comprises a front wall 13 and a rear wall 14 respectively mounted between the side walls 11, 12 to form a box shaped member which defines the receiving chamber 101 within the side walls 11, 12, the front wall 13, and the rear wall 14. The outer casing further comprises a top body 15 having two side boards 151, 152 integrally extended on top of rear portions of the side walls 11, 12 respectively, a top board 151 integrally formed on top of the side boards 151, 152, and a rear board 154 integrally and upwardly extended from the rear wall 14.

The cover body 20 further comprises a front cover panel 23 mounted between the side cover panels 21, 22 to define an enclosing chamber 201 within the front cover panel 23 and the two side cover panels 21, 22, wherein a distance between the two side cover panels 21, 22 of the cover body 20 equals to a distance between the two side walls 11, 12 of the outer casing 10 in such a manner that the cover body 20 is fittedly supported on the outer casing 10 while the bottom edges of the side cover panels 21, 22 of the cover body 20 are rested on the top edges of the side walls 11, 12 of the outer casing 10 respectively.

The inner casing 30 further comprises a front panel 33 and a rear panel 34 respectively mounted between the side panels 31, 32 to define the storage cavity 301. Accordingly, a distance between two inner surfaces of the side walls 11, 12 of the outer casing 10 must be larger than a distance between two outer surfaces of the side panels 31, 32 of the inner casing 30 and a distance between the front and rear walls 13, 14 of the outer casing 10 must be larger than a distance between the front and rear panels 33, 34 of the inner casing 30 in such a manner that the inner casing 30 is adapted to dispose in the receiving chamber 101 of the outer casing 10.

Moreover, a depth of the receiving chamber 101 is preferred to be smaller than a height of the inner casing 30 in such a manner that when the inner casing 30 is disposed in the outer casing 10, the lower portion of the inner casing 30 is received in the receiving chamber 101 while the upper portion of the inner casing 30 is exposed out of the receiving chamber 101 of the outer casing 10.

Thus, total depths of the receiving chamber 101 of the outer casing 10 and the enclosing chamber 201 of the cover 30 should be larger than the height of the inner casing 30 so that the inner casing 30 is adapted to dispose between the outer casing 10 and the cover 30 in the storage position so as to protect the product within the storage cavity 301 of the inner casing 30.

As shown in FIG. 1, each of the sliding pegs 43 is constructed to has an identical shape of each of the guiding pegs 44, wherein each of the sliding pegs 43 and the guiding pegs 44 has an enlarged free end portion 431, 441 having a size slightly larger than a width of the respective sliding track 41 and the guiding track 42, in such a manner that when the sliding pegs 43 and the guiding pegs 44 are inserted into the sliding track 41 and the guiding track 42, the free end portions 431, 441 of the sliding pegs 43 and the guiding pegs 44 are retained in the sliding track 41 and the guiding track 42 respectively, so as to prevent the cover 30 sliding off the outer casing 10 accidentally.

Each of the guiding tracks 42 has a track body portion 423 and a tail portion 424 transversely indented on the outer surface of the respective side panel 31, 32 of the inner casing 30 wherein the track body portion 423 is extended from the respective rear stopped end 422 and the tail portion 424 is downwardly and integrally extended from the track body portion 422 to the front stopped end 421 in a head-to-tail manner in such a manner that when the guiding pegs 44 of the cover 20 are stopped and positioned at the front stopped ends 421 of the guiding tracks 42, the cover 20 is slidably flipped with respect to the outer casing 10.

The rail-track display box further comprises a holder 50 having a ring-shaped detachably disposed in the storage cavity 301 by means of friction. The holder 50 is a looped band, made of stiffness material, adapted to be held within the storage cavity 301 such that the product such as a watch or jewelry is adapted to be mounted on the looped band of the holder 50 and held by the inner casing 30 for display purpose.

Figure 2:
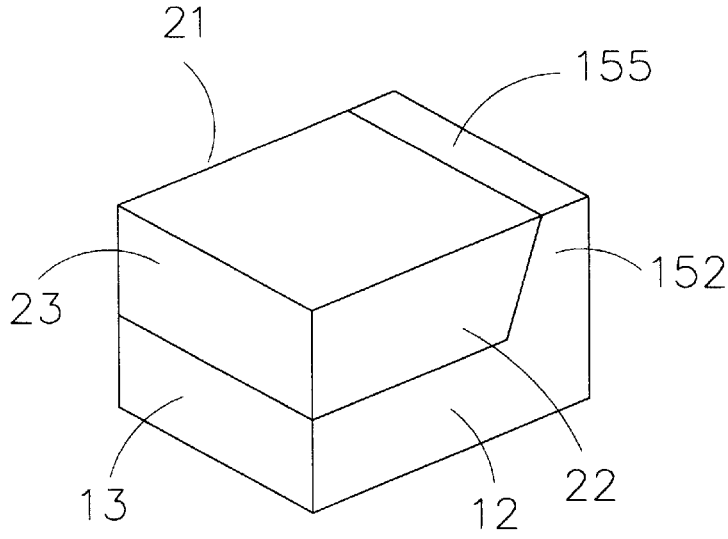
FIG. 2 is a perspective view of the rail-track display box in a closed position according to the above first preferred embodiment of the present invention.

For packaging and storing purpose, as shown in FIG. 2, the cover 20 is slid rearwardly while the sliding pegs 43 are stopped and positioned at the two rear blocked ends 412 of the sliding tracks 41 respectively and the guiding pegs 44 are stopped and positioned at the two rear stopped ends 422 of the guiding tracks 42 respectively, so that the cover 20 is supported on the outer casing 10 to enclose the storage cavity 301 of the inner casing 30. Therefore, the product is stored and protected inside the rail-track display box.

In order to display the product, the cover 20 is adapted to slid on the outer casing 10 while the sliding pegs 43 are slid along the sliding tracks 41 from the rear blocked ends 412 toward the front blocked ends 412 respectively and the guiding pegs 44 are slid along the guiding tracks 42 from the rear stopped ends 422 toward front portions of the track body portions 423 of guiding tracks 42 respectively. Then, the cover 20 is adapted to flip downwardly by sliding the guiding pegs 44 on the tail portions 424 of the guiding tracks 42 to the front stopped ends 421 thereof respectively while the sliding pegs 43 are rotated about the front blocked ends 411 of the guiding tracks 41 respectively. Therefore, the storage cavity 301 of the inner casing 30 is exposed outside for displaying the product.

Figure 4:
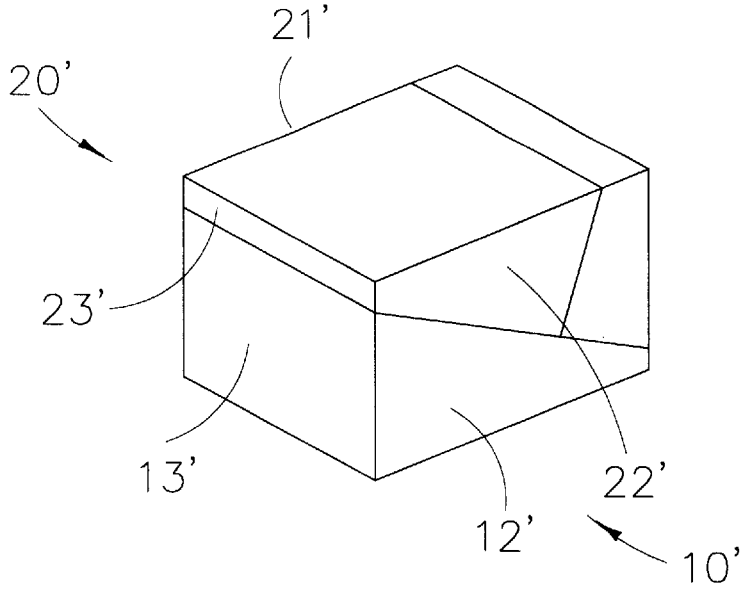
FIG. 4 is a perspective view of a rail-track display box in a closed position according to a second preferred embodiment of the present invention.
Figure 5:
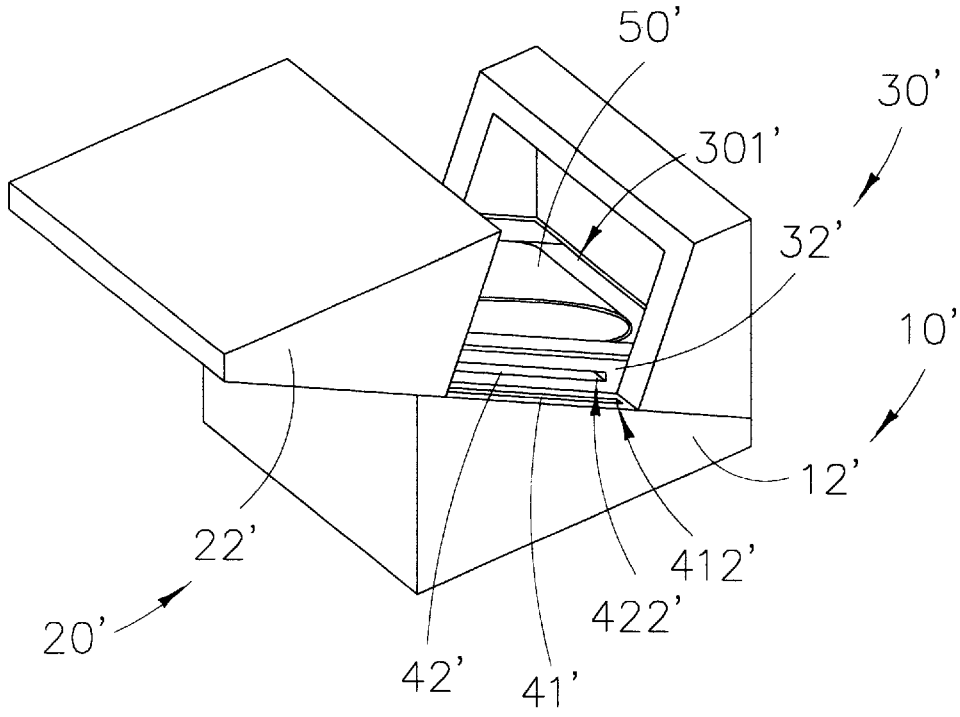
FIG. 5 is a perspective view of the rail-track display box in a display position according to the above second preferred embodiment of the present invention.

Referring to FIGS. 4 and 5 of the drawings, a rail-track display box of a second embodiment illustrates an alternative mode of the first embodiment, wherein each of the top edge of the side walls 11', 12' of the outer casing 10' is in an inclined angle. In other words, a height of each of the side walls 11', 12' is gradually reduced from a front portion to a rear portion to form the inclined top edge with the inclined angle.

As shown in FIG. 5, each of the bottom edge of the cover side panels 21', 22' of the cover 20' is in an inclined angle which matches with the inclined angle of the two edges of the side walls 11', 12' of the outer casing 10'. In other words, the cover 20' is slidably mounted on the outer casing 10' to form a box shaped structure that the bottom edges of the cover side panels 21', 22' are rested on the top edges of the side walls 11', 12' of the outer casing 10' respectively while the sliding pegs 43" are slidably inserted into the sliding tracks 41 respectively.

The guiding tracks 42 are inclinedly indented on the outer surfaces of the side panels 31', 32' of the inner casing 30' with respect to the inclined angles of the top edges of the side walls 11', 12' of the outer casing 10' in such a manner that the sliding and guiding pegs 43', 44' are correspondingly slid on the sliding and guiding tracks 41', 42' on the outer and inner casings 10', 30' respectively between the display position and the storage position.

Of course, each of the sliding pegs 43' and each of said guiding pegs 44' has an enlarged free end portion 431', 441' to retain the sliding pegs 43' and the guiding pegs 44' are retained in the sliding tracks 41' and the guiding tracks 42' respectively when the sliding pegs 43' and the guiding pegs 44' are mounted to the sliding track 41' and the guiding track 42' respectively.

Figure 6:
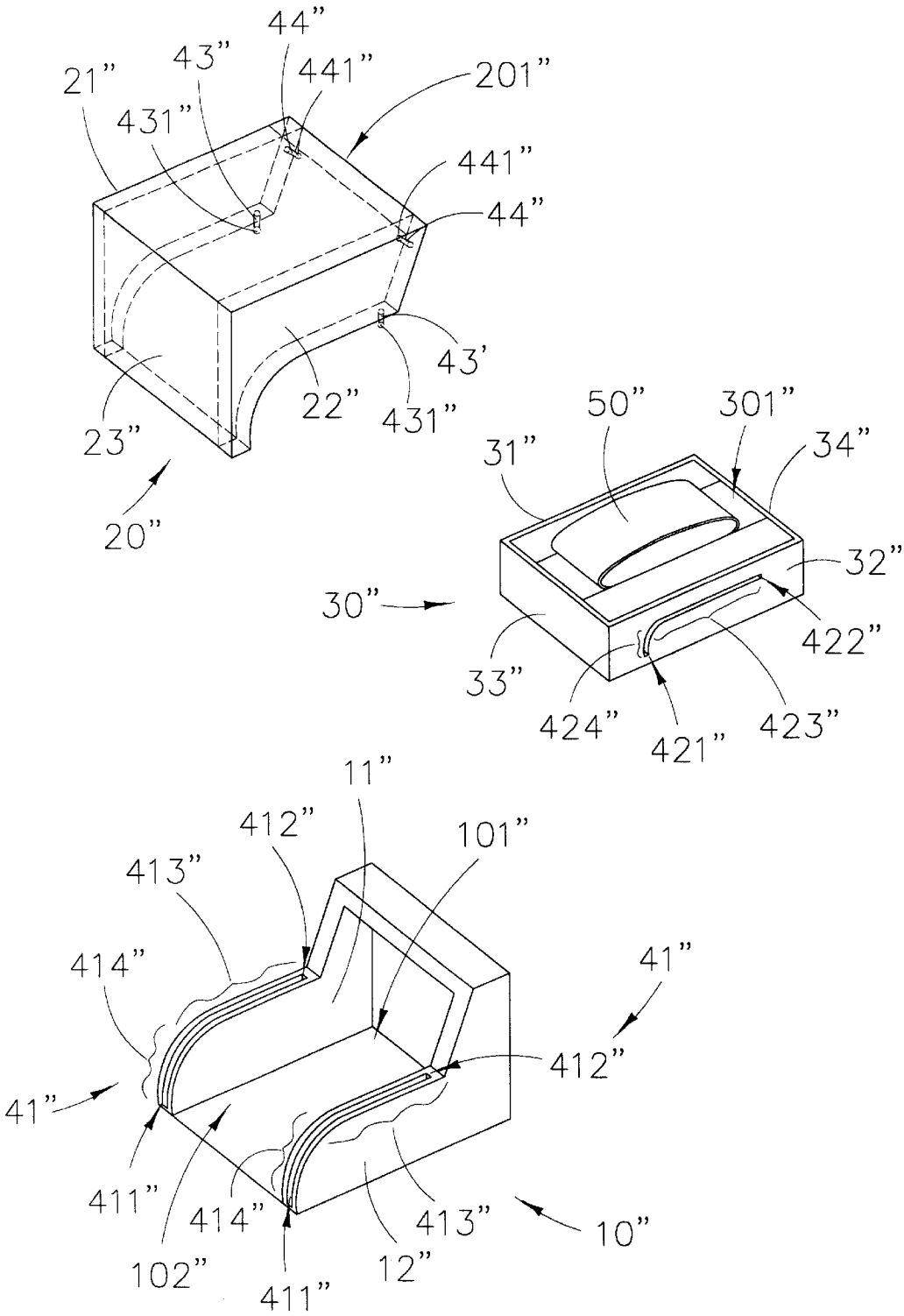
FIG. 6 is an exploded perspective view of a rail-track display box according to a third preferred embodiment of the present invention.

Referring to FIGS. 6, a rail-track display box according to a third embodiment illustrates another alternative of the first embodiment, wherein the cover 30" is adapted to flip over with respect to the outer casing 10" in the display position so that the cover 30" functions as a stand for the outer casing 10".

As shown in FIG. 6, the outer casing 10" has a receiving chamber 101", a top opening 102" communicating with the receiving chamber 101", and a pair of elongated sliding tracks 41" indented along two top edges of two parallel side walls 11", 12" of the outer casing 10" respectively, wherein each of the sliding tracks 41 has a front blocked end 411" and a rear blocked end 412".

Each of the sliding tracks 41" has a top guiding portion 413" extended from the rear blocked end 412" along the respective side wall 11", 12" of the outer casing 10" and a front guiding portion 414" extended to the front blocked end 411" along a front edge of the respective side wall 11", 12" in such a manner that the front blocked ends 411" of the sliding tracks 41" are positioned at bottom portions of the front edges of the side walls 11", 12" of the outer casing 10" respectively.

Accordingly, each of the side walls 11", 12" has a curved front top comer provided between the top edge and the front edge thereof in such a manner that the front guiding portions 414" of the sliding tracks 41" are integrally extended from the top guiding portions 413" of the sliding tracks 41" from the top edges of the side walls 11", 12" to the front edges along the front top corners respectively.

Each of the side panels 21", 22" of the cover 20" has a corresponding curved bottom edge arranged to fittedly rest on the top and front edges of the respective side wall 11", 12" of the outer wall 10".

Each of the guiding tracks 42" has a track body portion 423" and a tail portion 424" transversely indented on the outer surface of the respective side panel 31", 32" of the inner casing 30" wherein the track body portion 423" is extended from the respective rear stopped end 422" and the tail portion 424" is downwardly and curvedly extended from the track body portion 422" to the front stopped end 421" in a head-to-tail manner in such a manner that when the guiding pegs 44" of the cover 20" are stopped and positioned at the front stopped ends 421" of the guiding tracks 42", the cover 20" is slidably flipped with respect to the outer casing 10". A curvature of the tail portion 424" of each guiding track 42" with respect to the track body portion 423" thereof equals to a curvature of the front top corner of each side wall 11", 12" of the outer wall 10" in such a manner that the sliding and guiding pegs 43", 44" are respectively slid from the top guiding portions 413" of the sliding tracks 41" to the front guiding portions 414" thereof and the track body portion 423" of the guiding tracks 42" to the tail portion 424" thereof at the same time.

As shown in FIG. 6, each of the sliding pegs 43" and the guiding pegs 44" has an enlarged free end portion 431", 441" having a size slightly larger than a width of the respective sliding track 41" and the guiding track 42", in such a manner that the free end portions 431", 441" of the sliding pegs 43" and the guiding pegs 44" are retained in the sliding track 41" and the guiding track 42" respectively when the sliding pegs 43" and the guiding pegs 44" are mounted to the sliding track 41" and the guiding track 42" respectively.

Figure 7:
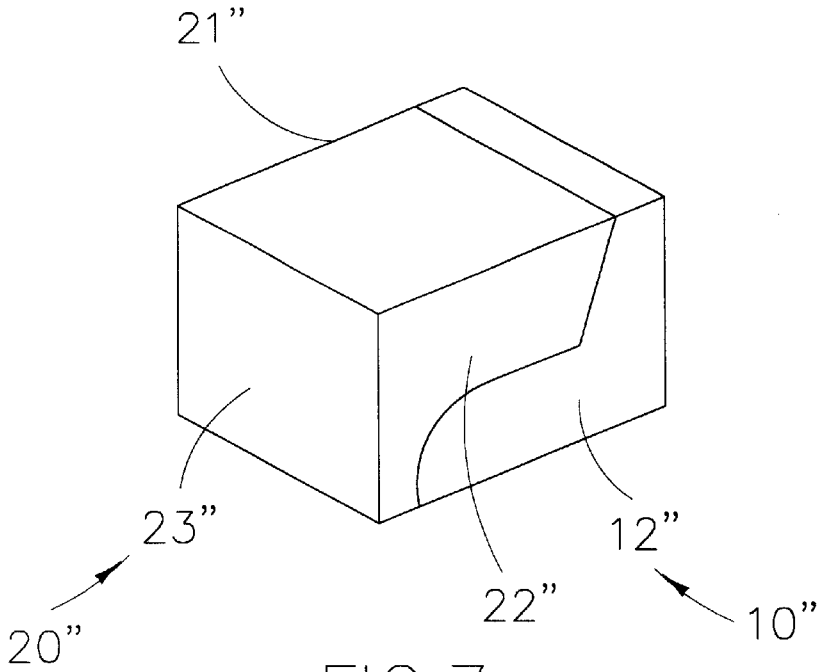
FIG. 7 is a perspective view of the rail-track display box in a closed position according to the above third preferred embodiment of the present invention.
Figure 8:
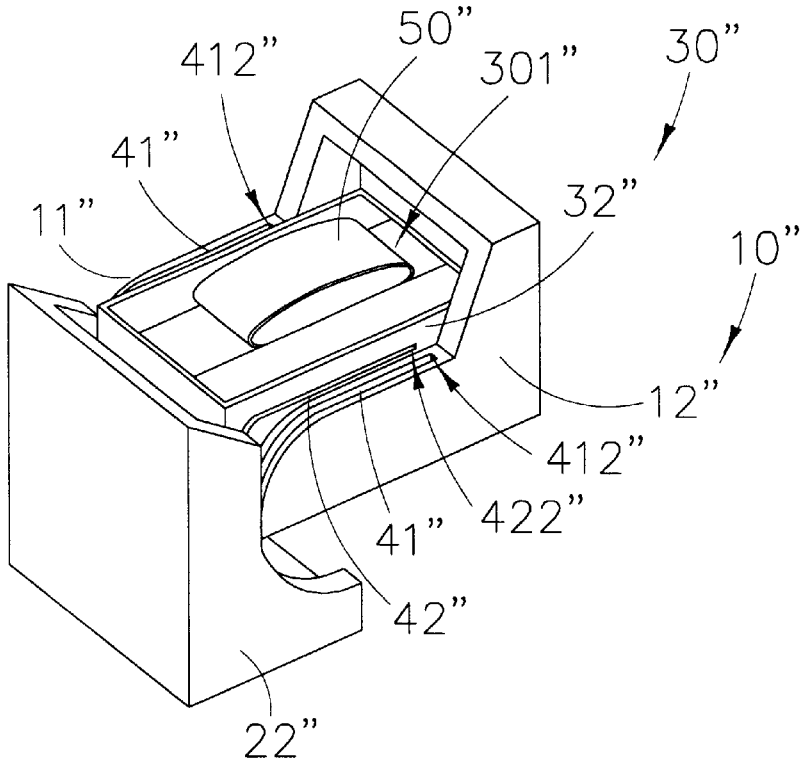
FIG. 8 is a perspective view of the rail-track display box in a display position according to the above third preferred embodiment of the present invention.

For packaging and storing purpose, as shown in FIG. 7, the cover 20" is slid rearwardly while the sliding pegs 43" are stopped and positioned at the two rear blocked ends 412" of the sliding tracks 41" respectively and the guiding pegs 44" are stopped and positioned at the two rear stopped ends 422" of the guiding tracks 42" respectively, so that the cover 20" is supported on the outer casing 10 to enclose the storage cavity 301" of the inner casing 30". Therefore, the product is stored and protected inside the rail-track display box.

The holder 50" having a ring-shaped detachably disposed in the storage cavity 301" by means of friction. The holder 50" is a looped band, made of stiffness material, adapted to be held within the storage cavity 301" such that the product such as a watch or jewelry is adapted to be mounted on the looped band of the holder 50" and held by the inner casing 30" for display purpose.

In order to display the product, the cover 20" is adapted to slid on the outer casing 10" while the sliding pegs 43 are slid along the top guiding portions 413" of the sliding tracks 41" from the rear blocked ends 412" toward front portions of the top guiding portions 413" of the sliding tracks 41" respectively and the guiding pegs 44" are slid along the guiding tracks 42" from the rear stopped ends 422" toward front portions of the track body portions 423" of guiding tracks 42" respectively.

Then, the cover 20" is adapted to flip downwardly by sliding the sliding pegs 43" along the front guiding portion 434" of the guiding tracks 43" toward the front block ends 431" thereof respectively while the guiding pegs 44" are slid on the tail portions 424" of the guiding tracks 42" to the front stopped ends 421" thereof respectively. Therefore, the cover 20" is flipped over with respect to the outer casing 10" so that the storage cavity 301" of the inner casing 30" is exposed outside for displaying the product.

What is claimed is:

1. A rail-track display box, comprising:

an outer casing having a receiving chamber, a top opening communicating with said receiving chamber, and a pair of elongated sliding tracks indented along two top edges of two parallel side walls of said outer casing respectively, wherein each of said sliding tracks has a front blocked end and a rear blocked end;

an inner casing having a storage cavity for receiving a product therein, wherein a lower portion of said inner casing disposed in said receiving chamber while an upper portion of said inner casing is exposed out of said receiving chamber, said inner casing further having a pair of guiding tracks indented on two outer surfaces of two side panels of said upper portion of said inner casing respectively, wherein each of said guiding tracks has a front stopped end and a rear stopped end; and a cover having a pair of sliding pegs inwardly and perpendicularly formed on two inner surfaces of two parallel side cover panels respectively and a pair of guiding pegs downwardly formed on two bottom edges of said side cover panels respectively, a distance of said two outer surfaces of said side panels of said inner casing being slightly smaller than a distance between said two inner surfaces of said two side cover panels of said cover, wherein said cover is placed on top of said outer casing while said two sliding pegs are slidably inserted into said two sliding tracks respectively and said two guiding pegs are slidably inserted into said two guiding tracks respectively;

said cover being adapted to slidably move between a display position and a storage position, wherein in said display position, said cover is slid frontwardly while said sliding pegs are stopped and positioned at said two front blocked ends of said sliding tracks respectively and said guiding pegs are stopped and positioned at said two front stopped ends of said guiding tracks respectively, so as to open said rail-track display box for displaying said product, and in said storage position, said cover is slid rearwardly while said sliding pegs are stopped and positioned at said two rear blocked ends of said sliding tracks respectively and said guiding pegs are stopped and positioned at said two rear stopped ends of said guiding tracks respectively, so that said cover is supported on said outer casing to enclose said storage cavity.

2. A rail-track display box, as recited in claim 1, wherein each of said guiding tracks has a track body portion and a tail portion transversely indented on said outer surface of said respective side panel of said inner casing, wherein said track body portion is extended from said respective rear stopped end and said tail portion is downwardly extended from said track body portion to said front stopped end in a head-to-tail manner in such a manner that when said guiding pegs of said cover are slid from said track body portions of said guiding tracks to said tail portions thereof, said cover is slidably flipped with respect to said outer casing.

3. A rail-track display box, as recited in claim 1, wherein each of said sliding pegs and each of said guiding pegs has an enlarged free end portion having a size slightly larger than a width of said respective sliding track and said guiding track, in such a manner that said free end portions of said sliding pegs and said guiding pegs are retained in said sliding track and said guiding track respectively when said sliding pegs and said guiding pegs are mounted to said sliding track and said guiding track respectively.

4. A rail-track display box, as recited in claim 2, wherein each of said sliding pegs and each of said guiding pegs has an enlarged free end portion having a size slightly larger than a width of said respective sliding track and said guiding track, in such a manner that said free end portions of said sliding pegs and said guiding pegs are retained in said sliding track and said guiding track respectively when said sliding pegs and said guiding pegs are mounted to said sliding track and said guiding track respectively.

5. A rail-track display box, as recited in claim 1, wherein a height of each of said side walls is gradually reduced from a front portion to a rear portion to form said top edge with an inclined angle, wherein each of said bottom edge of said cover side panels of said cover is in an inclined angle which matches with said inclined angle of said two edges of said side walls of said outer casing, in such a manner that said cover is slidably mounted on said outer casing to form a box shaped structure that said bottom edges of said cover side panels are rested on said top edges of said side walls of said outer casing respectively while said sliding pegs are slidably inserted into said sliding tracks respectively.

6. A rail-track display box, as recited in claim 5, wherein said guiding tracks are inclinedly indented on said outer surfaces of said side panels of said inner casing with respect to said inclined angles of said top edges of said side walls of said outer casing in such a manner that said sliding and guiding pegs are correspondingly slid on said sliding and guiding tracks on said outer and inner casings respectively between said display position and said storage position.

7. A rail-track display box, as recited in claim 5, wherein each of said sliding pegs and each of said guiding pegs has an enlarged free end portion having a size slightly larger than a width of said respective sliding track and said guiding track, in such a manner that said free end portions of said sliding pegs and said guiding pegs are retained in said sliding track and said guiding track respectively when said sliding pegs and said guiding pegs are mounted to said sliding track and said guiding track respectively.

8. A rail-track display box, as recited in claim 6, wherein each of said sliding pegs and each of said guiding pegs has an enlarged free end portion having a size slightly larger than a width of said respective sliding track and said guiding track, in such a manner that said free end portions of said sliding pegs and said guiding pegs are retained in said sliding track and said guiding track respectively when said sliding pegs and said guiding pegs are mounted to said sliding track and said guiding track respectively.

9. A rail-track display box, as recited in claim 1, wherein each of said sliding tracks has a top guiding portion extended from said rear blocked end along said respective side wall of said outer casing and a front guiding portion extended to said front blocked end along a front edge of said respective side wall in such a manner that said front blocked ends of said sliding tracks are positioned at bottom portions of said front edges of said side walls of said outer casing respectively.

10. A rail-track display box, as recited in claim 9, wherein each of said side walls has a curved front top corner provided between said top edge and said front edge thereof in such a manner that said front guiding portions of said sliding tracks are integrally extended from said top guiding portions of said sliding tracks from said top edges of said side walls to said front edges along said front top corners respectively.

11. A rail-track display box, as recited in claim 1, wherein each of said guiding tracks has a track body portion and a tail portion transversely indented on said outer surface of said respective side panel of said inner casing, wherein said track body portion is extended from said respective rear stopped end and said tail portion is downwardly and curvedly extended from said track body portion to said front stopped end in a head-to-tail manner.

12. A rail-track display box, as recited in claim 9, wherein each of said guiding tracks has a track body portion and a tail portion transversely indented on said outer surface of said respective side panel of said inner casing, wherein said track body portion is extended from said respective rear stopped end and said tail portion is downwardly and curvedly extended from said track body portion to said front stopped end in a head-to-tail manner.

13. A rail-track display box, as recited in claim 10, wherein each of said guiding tracks has a track body portion and a tail portion transversely indented on said outer surface of said respective side panel of said inner casing, wherein said track body portion is extended from said respective rear stopped end and said tail portion is downwardly and curvedly extended from said track body portion to said front stopped end in a head-to-tail manner.

14. A rail-track display box, as recited in claim 13, wherein a curvature of said tail portion of each said guiding track with respect to said track body portion thereof equals to a curvature of said front top corner of each said side wall of said outer wall in such a manner that said sliding and guiding pegs are respectively slid from said top guiding portions of said sliding tracks to said front guiding portions thereof and said track body portion of said guiding tracks to said tail portion thereof at the same time, so as to flip over said cover with respect to said outer casing.

15. A rail-track display box, as recited in claim 9, wherein each of said sliding pegs and each of said guiding pegs has an enlarged free end portion having a size slightly larger than a width of said respective sliding track and said guiding track, in such a manner that said free end portions of said sliding pegs and said guiding pegs are retained in said sliding track and said guiding track respectively when said sliding pegs and said guiding pegs are mounted to said sliding track and said guiding track respectively.

16. A rail-track display box, as recited in claim 10, wherein each of said sliding pegs and each of said guiding pegs has an enlarged free end portion having a size slightly larger than a width of said respective sliding track and said guiding track, in such a manner that said free end portions of said sliding pegs and said guiding pegs are retained in said sliding track and said guiding track respectively when said sliding pegs and said guiding pegs are mounted to said sliding track and said guiding track respectively.

17. A rail-track display box, as recited in claim 11, wherein each of said sliding pegs and each of said guiding pegs has an enlarged free end portion having a size slightly larger than a width of said respective sliding track and said guiding track, in such a manner that said free end portions of said sliding pegs and said guiding pegs are retained in said sliding track and said guiding track respectively when said sliding pegs and said guiding pegs are mounted to said sliding track and said guiding track respectively.

18. A rail-track display box, as recited in claim 12, wherein each of said sliding pegs and each of said guiding pegs has an enlarged free end portion having a size slightly larger than a width of said respective sliding track and said guiding track, in such a manner that said free end portions of said sliding pegs and said guiding pegs are retained in said sliding track and said guiding track respectively when said sliding pegs and said guiding pegs are mounted to said sliding track and said guiding track respectively.

19. A rail-track display box, as recited in claim 13, wherein each of said sliding pegs and each of said guiding pegs has an enlarged free end portion having a size slightly larger than a width of said respective sliding track and said guiding track, in such a manner that said free end portions of said sliding pegs and said guiding pegs are retained in said sliding track and said guiding track respectively when said sliding pegs and said guiding pegs are mounted to said sliding track and said guiding track respectively.

20. A rail-track display box, as recited in claim 14, wherein each of said sliding pegs and each of said guiding pegs has an enlarged free end portion having a size slightly larger than a width of said respective sliding track and said guiding track, in such a manner that said free end portions of said sliding pegs and said guiding pegs are retained in said sliding track and said guiding track respectively when said sliding pegs and said guiding pegs are mounted to said sliding track and said guiding track respectively.

* * * * *